United States Patent [19]

Greenfield, Jr. et al.

[11] 4,059,181

[45] Nov. 22, 1977

[54] MEAL-SERVICE POWDERED FOODS DISPENSER

[75] Inventors: Irving E. Greenfield, Jr.; Ronald C. Jacobson, both of Miami, Fla.

[73] Assignee: Food Systems, Inc., Miami, Fla.

[21] Appl. No.: 646,554

[22] Filed: Jan. 5, 1976

Related U.S. Application Data

[63] Continuation of Ser. No. 498,243, Aug. 16, 1974, abandoned.

[51] Int. Cl.[2] ..... G07F 13/06

[52] U.S. Cl. ..... 194/13; 222/70; 222/129.4

[58] Field of Search ..... 222/129.1, 129.4, 70, 222/2, 135, 144.5, 132, 133, 129.3, 63, 129, 362, 370; 194/9 T, 13

[56] References Cited

U.S. PATENT DOCUMENTS

| | | | |
|---|---|---|---|
| 2,729,376 | 1/1976 | Gould et al. | 222/2 X |
| 3,150,798 | 9/1964 | Sutton | 222/70 X |
| 3,313,450 | 4/1967 | Erickson | 222/70 X |
| 3,531,019 | 9/1970 | Rodgers | 222/129.4 X |
| 3,671,020 | 6/1972 | Krup | 222/129.4 X |

*Primary Examiner*—Stanley H. Tollberg
*Attorney, Agent, or Firm*—Clarence A. O'Brien; Harvey B. Jacobson

[57] ABSTRACT

A powdered foods dispenser capable of dispensing multiple powdered foods for mixing with water externally of the dispenser for effective use in institutional meal service areas. The dispenser includes supply canisters for powdered foods and a dispensing mechanism associated therewith which is electrically operated for discharging a predetermined quantity of powdered food into an external receptacle with the dispensing mechanism for each powdered food being controlled by a manually actuated pushbutton and adjustable timer for controlling the quantity of powdered food dispensed. In one embodiment of the invention, as many as six different powdered foods may be dispensed with a supply of hot water also being available, In another embodiment of the invention, only two powdered foods, such as coffee and tea, are dispensed with the dispenser being convertible from free operation to coin controlled operation.

10 Claims, 6 Drawing Figures

MEAL-SERVICE POWDERED FOODS DISPENSER

This is a continuation of application Ser. No. 498,243, filed Aug. 16, 1974 now abandoned.

CROSS-REFERENCE TO RELATED APPLICATION

The dispenser disclosed in this application includes some of the features of the dispenser disclosed in co-pending application Ser. No. 461,457 filed Apr. 16, 1974, now U.S. Pat. No. 3,915,207, issued Oct. 28, 1975, for HIGH-SPEED AUTOMATIC POWDERED FOOD AND HEATED WATER DISPENSER, having a common assignee, with the disclosure in that application being incorporated herein by reference thereto.

BACKGROUND OF THE INVENTION

1. Field of the Invention

The present invention generally relates to a dispenser for powdered foods capable of external discharge of a perdetermined quantity of a selected powdered food product into a receptacle for external mixing with water with the quantity of product being dispensed for each cycle of operation being variable and the dispensing device being electrically operated upon actuation of a control switch.

2. Description of the Prior Art

In addition to the prior U.S. patents discussed in the aforementioned co-pending application, the following U.S. patents disclose dispensing device of various types which perform various dispensing functions:

| | |
|---|---|
| 2,552,413 | 5/ 8/51 |
| 2,643,026 | 6/23/53 |
| 2,755,000 | 7/17/56 |
| 2,770,396 | 11/13/56 |
| 2,954,145 | 9/27/60 |
| 3,045,719 | 7/24/62 |
| 3,157,313 | 10/17/64 |
| 3,204,832 | 9/ 7/65 |
| 3,308,898 | 3/14/67 |
| 3,379,344 | 4/23/68 |
| 3,430,814 | 3/ 4/69 |
| 3,435,992 | 4/ 1/69 |
| 3,444,892 | 5/20/69 |
| 3,297,210 | 1/10/67 |
| 3,533,374 | 10/13/70 |

SUMMARY OF THE INVENTION

An object of the present invention is to provide a meal service powdered foods dispenser that is electrically operated, capable of dispensing multiple products, provided with or without a heated water dispensing facility, provided with or without a coin control facility, constructed in a relatively small size to provide portability and ease of installation in various institutional facilities, and the like, having a relatively small available space, and being capable of operation, servicing and installation or relocation by institutional personnel.

Another object of the invention is to provide a meal service powdered foods dispenser which includes an electrical operation of the dispensing mechanism for dispensing a controlled portion of a selected powdered food which enables maximum utility of the inherent benefits from the use of powdered foods such as improvements in labor cost, product cost and control, shelf life, storage space, food loses and quality control.

A further object of the invention is to provide a powdered foods dispenser in accordance with the preceding objects incorporating a cabinet structure supported on a supporting surface, such as a counter space, or hung from a wall surface, with canisters disposed therein for receiving powdered foods with the canisters being constructed to utilize maximum space for attaining maximum utility of the interior of the cabinet with all operational features and controls being enclosed, except for the pushbutton actuator of a switch, thereby providing extreme simplicity of control which eliminates operator training and enables operation by anyone capable of selecting the desired product and capable of operating the simpliest possible control.

Still another object of the present invention is to provide a dispenser in accordance with the preceding objects which may be converted from a free operation to a coin controlled operation by the manipulation of a simple switch, thus increasing the range of utility of the dispenser including installations where no restrictions are provided on the operation of the dispenser as well as operations where a coin or token must be used with the coin or token control being quite simple since the device is not intended for use as a vending mechanism in the customary sense.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
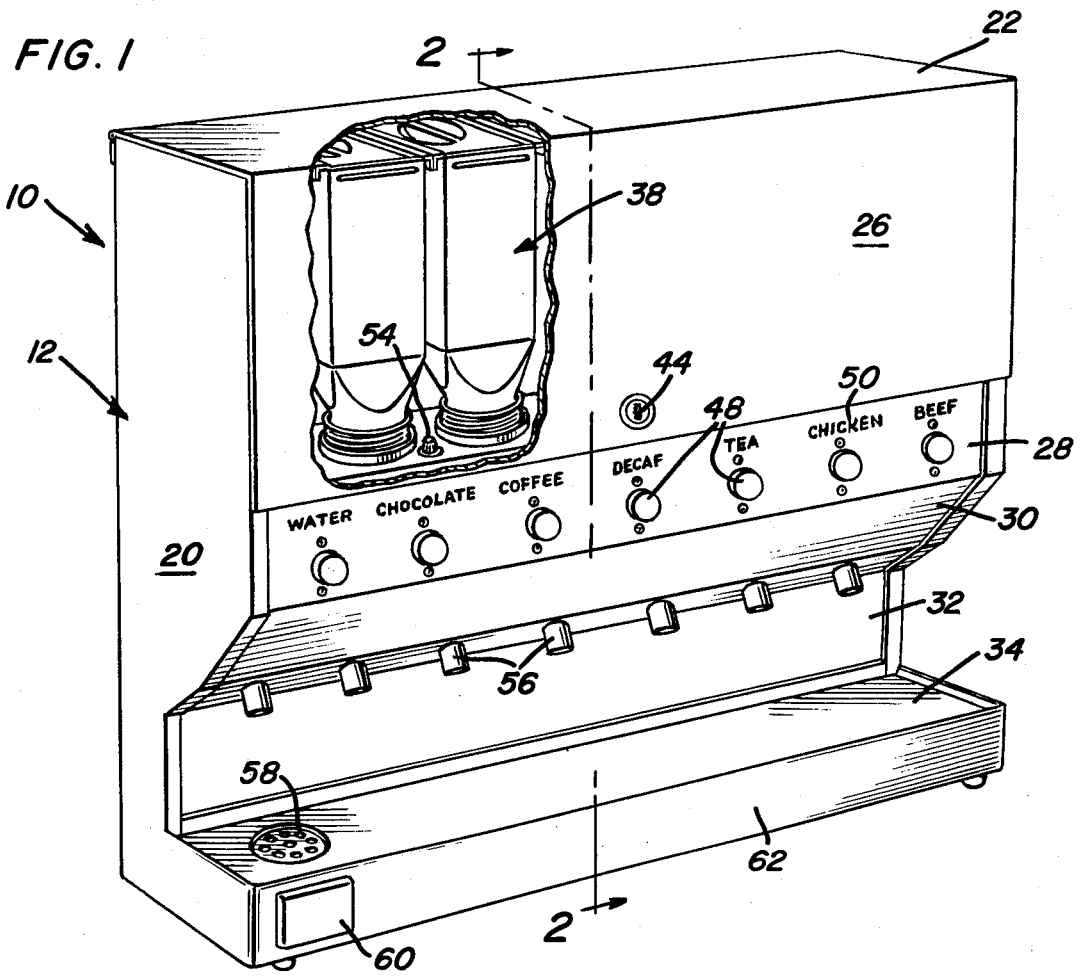
FIG. 1 is a perspective view of a dispenser capable of dispensing six powdered foods and water externally with portions of the cabinet broken away illustrating the supply canisters therein.
Figure 2:
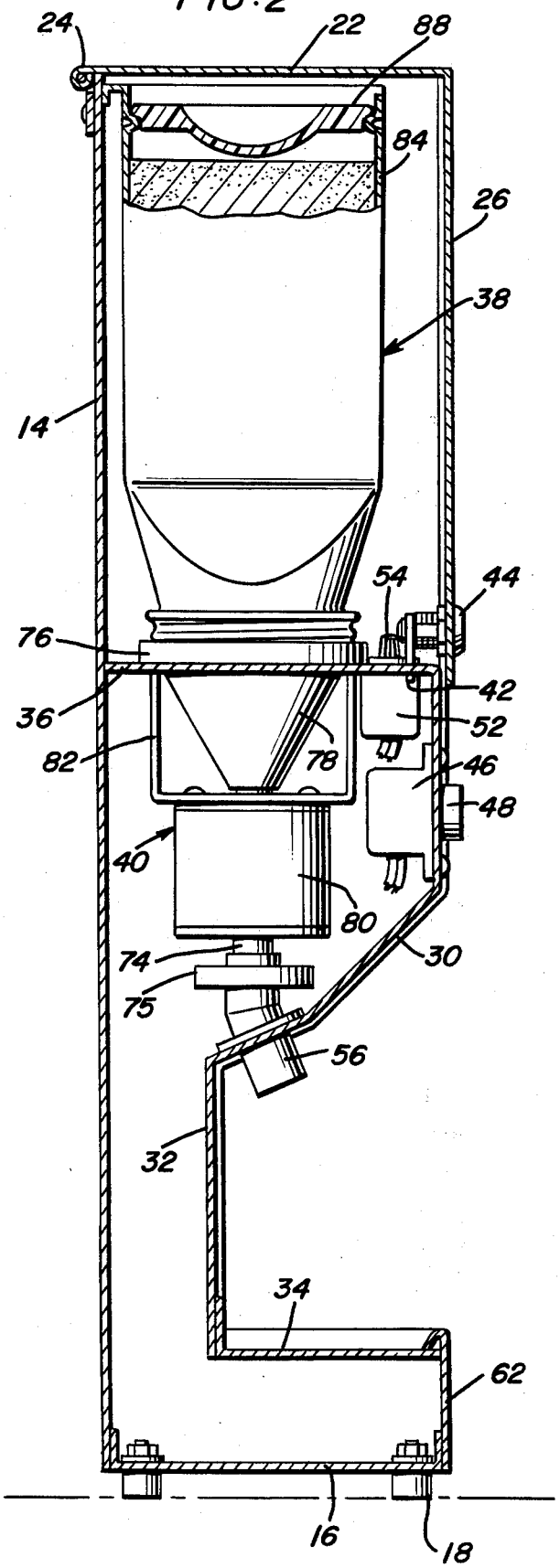
FIG. 2 is a vertical sectional view, on an enlarged scale, taken substantially upon a plane passing along section line 2—2 of FIG. 1, illustrating the relationship of the components in the dispenser.
Figure 3:
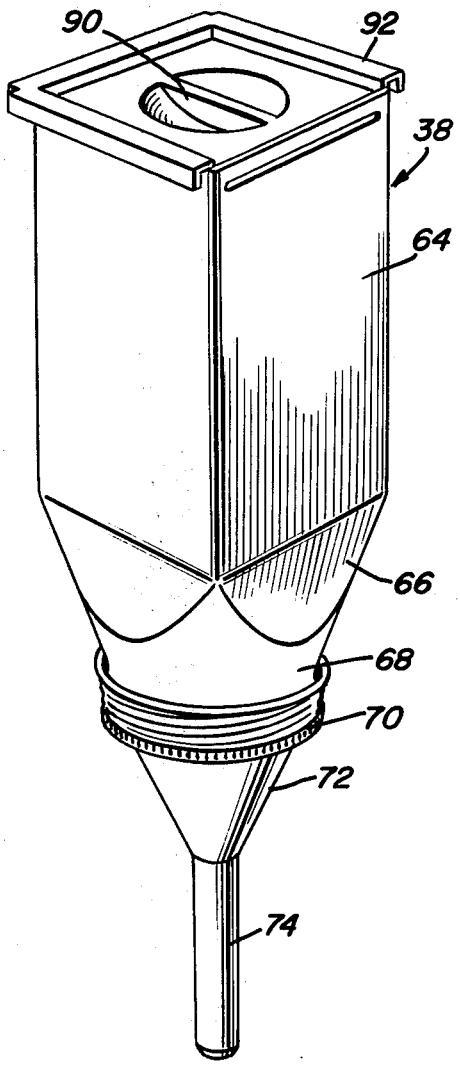
FIG. 3 is a perspective view of one of the canisters.

Referring now specifically to FIGS. 1–3, a six-product powdered foods dispenser as illustrated and generally designated by the numeral 10 and includes a cabinet structure 12 of generally upstanding, rectangular configuration defined by a rear wall 14, a bottom wall 16 provided with supporting pads or feet 18 of any suitable construction, such as resilient material, or the like, end walls 20, a top wall 22 hinged to the top edge of the rear wall 14 by hinge structure 24 and a front wall 26 perpendicular to the top wall 22 and rigid therewith for pivotal swinging movement about the hinge 24 for providing access to the interior of the cabinet. The front of the cabinet 12 also includes a control panel 28 forming generally an extension of the front wall 26 which includes an inwardly inclined portion 30 terminating in a vertical panel 32 which is secured at its lower edge to a horizontal supporting tray 34, with these components being connected to each other and to the other panels or walls in a conventional manner to provide a hollow cabinet which can be supported on a supporting surface, such as a counter space or supported from a wall surface, or the like. The interior of the cabinet 12 is provided with a horizontal partition 36 which provides a supporting structure for a plurality of supply canisters, generally designated by the numeral 38, and dispensing mechanisms generally designated by the numeral 40. Also, the partition 36 is engaged by a key operated lock arm 42 on a lock device 44 oriented at the bottom edge of the front wall 26 to enable the cabinet to be locked in a closed condition, except when the supply of material in the canister 38 is being replenished.

The control panel 28 is provided with a plurality of switches 46 mounted interiorly thereof with a pushbutton control or actuator 48 projecting outwardly of the panel 28 for access. Associated with each pushbutton 48 is indicia 50 designating the particular powdered food product controlled by that particular pushbutton 48. As illustrated, six powdered foods can be dispensed with the seventh pushbutton control being for hot water. The hot water heater and dispenser structure including the adjustable timer is the same as that disclosed in co-pending application Ser. No. 461,457 and the details thereof are not shown herein, but the structural details disclosed in the co-pending application is included herein by reference thereto. Each switch 46 is also associated with an adjustable timer 52 that may be conveniently mounted on the partition 36 with a control knob 54 accessible to the top surface of the partition 36 for varying the period of operation of the dispensing mechanism 40 when the pushbutton 48 is depressed thereby enabling the quantity of material dispensed to be varied. This adjustable timer construction is the same as that disclosed in co-pending application Ser. No. 461,457. An adjustable time associated with the water dispenser in the same manner as in the co-pending application is provided if desired which allows the quantity of water dispensed per serving to be varied in order to match the quantity of powdered food being dispensed. Additionally, the water dispenser may be provided with a manual switch which can be operated when more water than is necessary for a single serving is desired, such as when filling a large container, pitcher, or the like. Where a heated water supply is available, it is not necessary to utilize the water heater and dispensing mechanism.

Each of the powdered food dispensing mechanisms 40 and also the water dispenser, if provided, includes a discharge spout 56 in the form of a tubular member extending through the inclined wall 30 for discharging material into a cup or other container positioned on the tray 34. A perforated drain 58 may be provided in the tray 34 in underlying relation to the discharge spout for water with a removable tray 60 being provided in the partial front wall 62 if desired to provide for removal of any accidental spillage.

Each canister 38 for a powdered food product is in the form of a vertically elongated square receptacle 64 having a tapering lower end 66 smoothly merging into a screw threaded neck 68 to which is threaded a screw threaded cap 70 having a funnel-shaped element 72 and tubular member 74 connected thereto which forms part of the dispensing mechanism which is the same as that disclosed in co-pending application Ser. No. 461,457 with it being pointed out that other types of dispensing mechanisms may be employed. The assembly illustrated in FIG. 3 is disposed within a annular ring or socket 76 secured to the partition 36 and including a depending funnel-shaped structure 78. A solenoid device 80 is supported from a bracket 82 carried by the partition 36 to operate the dispensing mechanism. The dispensing mechanism operates in the same manner as disclosed in the aforementioned co-pending application. One type of dispensing mechanism which can be used is also disclosed in U.S. Pat. No. 3,204,832, issued Sept. 7, 1965, with the specific details of the dispensing mechanism being varied as desired and forming no particular part of the present invention except for its association with the other components. As illustrated, the container 64 receives a quantity of powdered food product 84 and the upper end thereof is closed by a closure lid or plug 88 of plastic or resilient material frictionally or gravitationally positioned and provided with a recessed handle structure 90 in the upper surface thereof. The closure means for the receptacle or canister may be varied and may be of any suitable type, but preferably forms a relatively good seal against moisture to assure that the powdered food product will not absorb moisture. The upper end of the canister 64 may be provided with a return bend flange or hook-shaped structure 92 to space and position the canisters in relation to each other and to vertically engage a supporting partition wall or rear wall when cabinets having specific structural features to accommodate such flanges are provided. As illustrated, the canister structures are such that substantially the entire space provided interiorly of the cabinet is occupied, thus providing volumetric efficiency. Also, if desired, each of the dispensing mechanisms or discharge spouts may be provided with a heater 75, such as that disclosed in co-pending application Ser. No. 461,457, and the specific configuration of the discharge spout may be varied as desired. For example, the discharge spout 56 may be straight if the wall 32 is moved closer to the rear wall 14.

Figure 6:
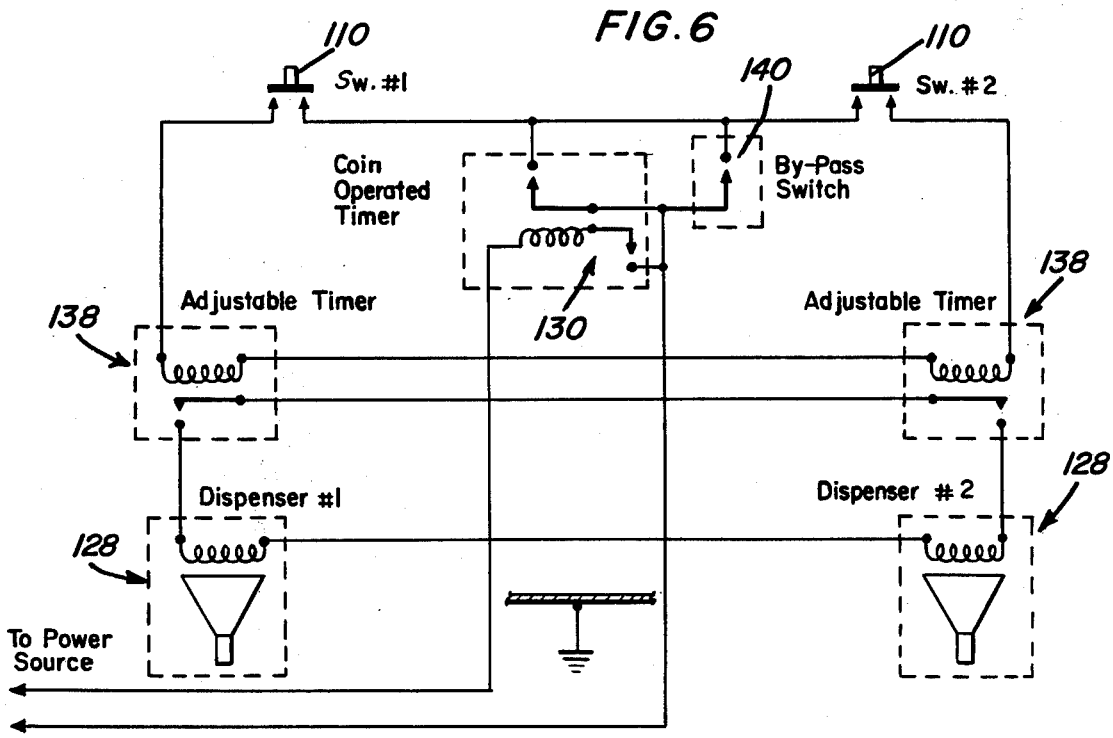
FIG. 6 is a schematic wiring diagram illustrating diagrammatically the electrical circuit incorporated into the two product dispenser of FIGS. 4 and 5.
Figure 4:
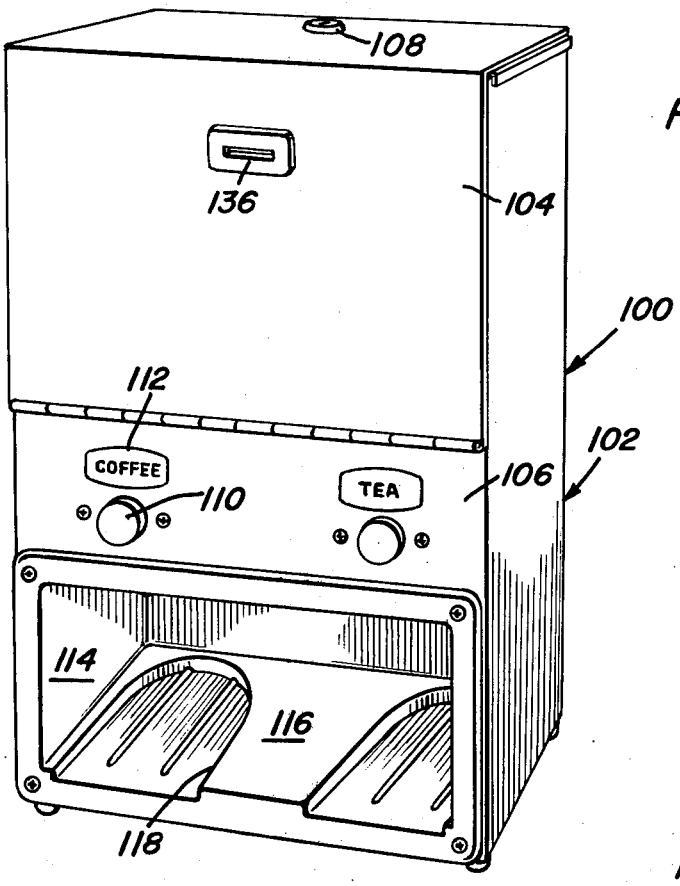
FIG. 4 is a perspective view of a dispenser for dispensing two powdered foods with an optional coin control.
Figure 5:
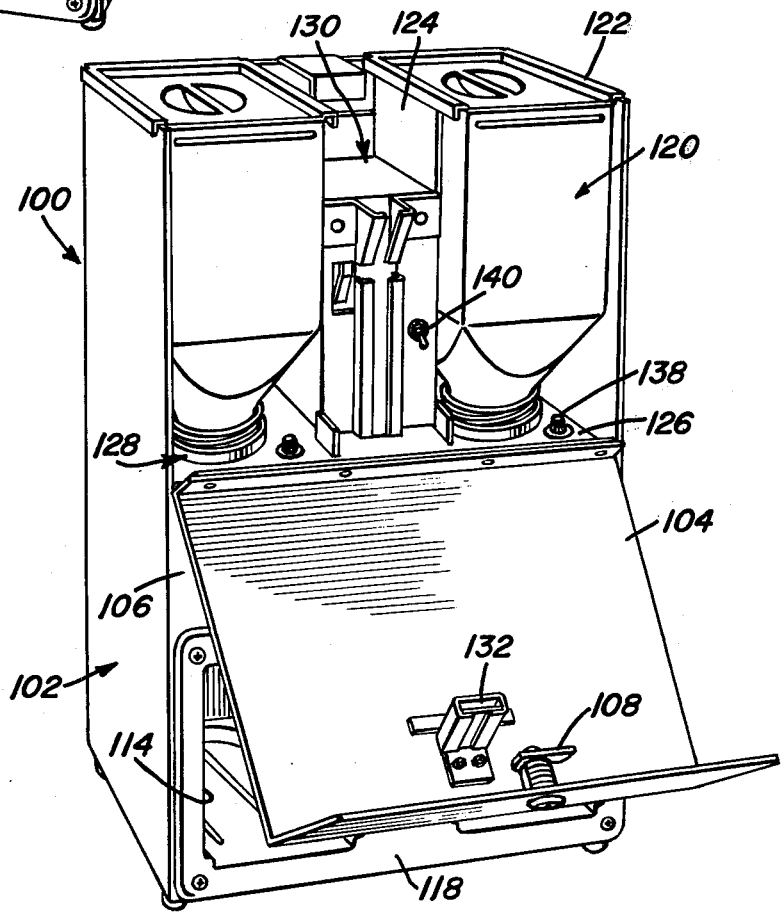
FIG. 5 is a perspective view similar to FIG. 4 but with the access door on the cabinet in open position.

FIGS. 4 and 5 disclose an embodiment of the dispenser generally designated by numeral 100 for dispensing two of the most popular powdered food products, such as coffee and tea. This dispenser is smaller than that illustrated in FIGS. 1–3 and also includes a hollow cabinet structure 102 having an L-shaped access door 104 hinged to the top edge of a front control panel 106 and provided with a lock device 108 which may be key operated. Two pushbuttons 110 are provided in adjacent relation to indicia 112 on the front panel 106 for operating the dispenser with the front wall also including a recess area 114 defined in part by bottom wall 116 having U-shaped recesses 118 therein to guide and position a cup or other receptacle in underlying relation to the discharge spout from the dispensing mechanisms which are operated by the pushbuttons 110. In this construction, the canisters 120 and the dispensing mechanisms connected thereto are the same as illustrated in FIGS. 1–3 but in this construction the reversely folded flanges 122 at the upper end of the canister 120 are supported on the top edges of the rear walls, end walls and vertical partition walls 124 within the cabinet. The vertical partition walls 124 extend upwardly from the horizontal partition wall 126 which supports the dispensing mechanisms 128 in the same manner as in FIGS. 1–3. Disposed between the partition walls 124 is a coin control mechanism generally designed by the numeral 130 which is aligned with a chute 132 mounted on the front wall 104 for receiving coins inserted through a slot 136. The coin control 130 operates to energize a circuit to the pushbutton switch 110 and a timer associated therewith designated by numeral 138 so that in order to operate either of the dispensing mechanisms, a coin or token must be inserted into the apparatus through the slot 136. Insertion of such a coin or token will operate the coin control mechanism and close the circuit to the pushbutton switches 110 in a manner so that either of the pushbuttons 110 may be actuated for dispensing a predetermined quantity of powdered food into a cup placed in one of the recesses 118 with the timer 138 being adjustable to control the quantity. Various types of coin control mechanisms may be employed but since the device is primarily intended for use in institutional meal service operations, the coin control device may be quite simple without slug rejectors, change makers, and the like, with the details of the coin control being illustrated since such details do not form a specific part of the invention except in association with its other components. Various types of commercially available coin control mechanisms may be utilized and the coin control mechanism may be by-passed by operating a simple manual switch 140 oriented in any suitable position so that the coin control will be by-passed. When the coin control is by-passed, the slot 136 should be covered with a decal or other similar material so that a person will not insert a coin or token into the slot 136 when it is not necessary. FIG. 6 illustrates schematically the electrical circuit involved in the structure illustrated in FIGS. 4 and 5 with it being pointed out that the particular location of the manual switch 140, the timers and their adjustable control 138 may be varied with the coin control mechanism also being varied as to position, location and construction.

This type of device can conveniently be supported from a vertical wall or on a counter space and, where desired, the multiple units may be supported alongside of each other. This unit provides multiple product capacity, variable serving size capability and is convertible from free operation to coin or token operation and is operated electrically and does not include any water supply or water heating structures and is oriented where a hot water supply is available. Variation in the timer control enables portion control and the dispensing mechanisms may be provided with a product heater in the same manner as in prior application Ser. No. 461,457.

The dispenser of this invention is specifically constructed for institutional meal service and is capable of dispensing multiple powdered foods, such as six products, two products, or any multiple thereof with or without a water dispensing facility or with or without a coin control facility. The dispensing unit is constructed so that it is of a relatively small size to facilitate portability with the size and weight of the unit being particularly suitably for hospital convenience food pantries, hospital (on floor) nourishment stations, hospital central kitchen feeding lines (supply for non-standard items such as broths, cocoa, dietetic soups, and the like), school cafeteria teacher service areas, nursing home patient operation (simplicity allows use by geriatric patients) and kitchen use in smaller institutions. The device may be operated, serviced and moved by nurses, cafeteria managers, dieticians, volunteer aids and the like which facilitates efficient use of the device. The unit may be wall hung or supported in a very small counter space.

This dispensing device is electrical in operation and dispenses only the product in an expedient, accurate and reliable manner. The dispenser is low cost per unit but yet provides necessary performance characteristics with multiple units or single units being provided as required for different installations. The dispenser provides many savings to institutional users since it will replace expensive coffee brewers, tea and cocoa dispensers and individual single service packets, eliminates labor costs in preparation and clean up, eliminates waste, eliminates pilferage, assures uniformity through portion control and provides positive cost control. The external mixing of powdered food and water insures sanitation, prevents corss contamination, eliminates the worst cleaning problem associated with powdered food dispensers and prevents machine malfunction due to steam caused powder clogging from internal hot water source. The external variability of the serving size or portion is required for hospital meal services due to frequency of non-standard requirements such as urns of coffee, liquid diet needs, non-meal service and the like and the machine user can also vary the serving size when desired, rather than requiring the services of a skilled technician.

The dispenser provides unlimited product variety due to its ability to change of any of many products without machine disassembly, internal cleaning, exchange of parts, mechanical alteration or metering adjustment and also the ability to use the dispenser several times per meal, such as for soups, after which coffee and tea may be dispensed. The simplicity of the dispenser enables operation without any training or an operator so that operation is suitable by non-food service personnel, such as nurses, attendants, volunteer aids, and the like, and enables use of a relatively simple structure as compared to more complicated equipment and enables utilization of hot water already available. The convertability to coin or token control is instantly available through a manual switch without any mechanical alternation by anyone with a key, tnus eliminating the service of a skilled technician or service man with the coin control being primarily a simple device that does not vend the product in the usual sense since it does not provide change, slug rejection, and the like.

The canister construction which provides for most efficient use of the space involved reduces the necessity of frequent refilling or removal from the dispenser of the supply container which requires handling of the dispensing funnel which produces problems relating to malfunction of the dispensing mechanism itself. The increase in machine capacity is significant and the particular construction of the canister is such that it prevents spillage into the interior of the machine thereby providing a substantial sanitary improvement as well as a time saver with respect to cleaning of the machine. The canister is constructed of translucent or transparent material, such as plastic, or the like, which will show when refilling is necessary and the flange at the top of the canister will prevent food powder from falling into the machine or between the cabinet and the canister. In some instances, the canister may be built into the cabinet thus, in effect, providing hoppers that are integral with the cabinet so that the hoppers may be filled, thus eliminating separate canisters and the necessity of removing the canisters for refilling.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A powdered foods dispenser comprising a supply container for powdered food product, electrically operated means dispensing a quantity of powdered food product from the container, said electrically operated means being oriented at the bottom of the supply container for a gravity discharge of the food product only into an underlying user receptacle without mixing, and means varying the quantity of product discharged upon actuation of the electrically operated means, said supply container and electrically operated means being disposed in a cabinet with the electrically operated means including a pushbutton exposed to the exterior of the cabinet for enabling operation of the dispenser, at least one additional supply container and electrically operated means disposed in the cabinet to enable dispensing of multiple powdered foods with each electrically operated means including a pushbutton disposed exteriorly of the cabinet, said means for varying the quantity of product dispensed including an adjustable timer forming part of the electrically operated means for varying the time of operation thereof, said supply container being in the form of a canister removably mounted in said cabinet, said canister having a closure member at the upper end thereof for enabling refilling of the canister, said canister including an upper edge having outwardly projecting flange means thereon supported on the upper cabinet edges to prevent spillage of powdered foods in the interior of the cabinet.

2. The structure as defined in claim 1 wherein the cabinet includes an access door enclosing the canister and adjustable timer, said access door having a key operated lock device mounted thereon.

3. The structure as defined in claim 2 together with water dispensing means mounted in said cabinet for supplying water to the receptacle for mixture with the product externally of the dispenser.

4. The structure as defined in claim 3 wherein said water dispensing means includes an adjustable timer for varying the quantity of water dispensed per serving to match the quantity of powdered food dispensed.

5. A powdered foods dispenser conmprising a supply container for powdered food products, electrically operated means dispensing a quantity of powdered food product from the container, said electrically operated means being oriented at the bottom of the supply container for a gravity discharge of the product into an underlying receptacle, and means varying the quantity of product discharged upon actuation of the electrically operated means, said supply container and electrically operated means being disposed in a cabinet with the electrically operated means including a pushbutton exposed to the exterior of the cabinet for enabling operation of the dispenser, said means for varying the quantity of product dispensed including an adjustable timer forming part of the electrically operated means for varying the time of operation thereof, said supply container being in the form of a canister removably mounted in said cabinet, said canister having a closure member at the upper end thereof for enabling refilling of the canister, said canister also including an upper edge having outwardly projecting flange means associated with the cabinet to prevent spillage of powdered foods in the interior of the cabinet, the cabinet including an access door enclosing the canister and adjustable timer, said access door including a key operated lock device, and coin control means for activating the electrically operated means upon deposit of a coin and by-pass switch means associated with the coin control means and the electrically operated means to enable the coin control means to be by-passed for free operation of the dispenser.

6. The structure as defined in claim 5 wherein each canister includes reversely folded flange means at the upper end thereof, said cabinet including wall means supporting said flange means to prevent food powder spillage into the cabinet when each canister is refilled.

7. A powdered foods dispenser comprising a supply container for powdered food product, electrically operated means dispensing a quantity of powdered food product from the container, said electrically operated means being oriented at the bottom of the supply container for a gravity discharge of the food product only into an underlying user receptacle without mixing, and means varying the quantity of product discharged upon actuation of the electrically operated means, said supply container and electrically operated means being disposed in a cabinet with the electrically operated means including a pushbutton exposed to the exterior of the cabinet for enabling operation of the dispenser, at least one additional supply container and electrically operated means disposed in the cabinet to enable dispensing of multiple powdered foods with each electrically operated means including a pushbutton disposed exteriorly of the cabinet, each supply container being in the form of a canister removably mounted in the cabinet, each canister including a bottom discharge area connected to said electrically operated means and a top closure to enable refilling, each supply container including flange means at the upper end thereof, said cabinet including wall means supporting said flange means.

8. A powdered foods dispenser comprising a supply container for powdered food products, electrically operated means dispensing a quantity of powdered food product from the container, said electrically operated means being oriented at the bottom of the supply container for a gravity discharge of the product into an underlying receptacle, said supply container and electrically operated means being disposed in a cabinet with the electrically operated means including a pushbutton exposed to the exterior of the cabinet for enabling operation of the dispenser, and coin control means for activating the electrically operated means upon deposit of a coin and by-pass switch means associated with the coin control means and the electrically operated means to enable the coin control means to be by-passed for free operation of the dispenser.

9. A meal service powdered foods dispenser for independently dispensing a selected powdered food product directly into a user receptacle while in a dry state, said dispenser comprising a supply container for each powdered food product, independent electrically operated means communicating with the lower end portion of each supply container and including a depending spout for dispensing a quantity of powdered food product from the container by a gravity discharge of only the selected product while in a dry state directly into an underlying user receptacle positioned in alignment with the depending spout and adjustable timer means varying the operating cycle of each electrically operated means thereby varying the quantity of each product discharged upon each actuation of the electrically operated means said supply containers and electrically operated means being disposed in a cabinet, each depending spout extending downwardly from a portion of the cabinet in a position to enable a user receptacle to be readily positioned thereunder, each electrically operated means including a pushbutton exposed to the exterior of the cabinet generally in alignment with the above the respective spouts for enabling independent operation of each electrically operated means by a user after a user receptacle has been placed under the spout for the selected product.

10. The structure as defined in claim 9 together with water dispensing means mounted in said cabinet, said water dispensing means including a depending spout aligned with the product spouts, a pushbutton exposed to the exterior of the cabinet and aligned with the product pushbuttons whereby product and water dispensed into the user receptacle are mixed only exteriorly of the cabinet, and adjustable timer means for varying the quantity of water supplied to the user receptacle to provide the desired mixture of water and product.

* * * * *